US008942406B2

(12) United States Patent
Koizumi

(10) Patent No.: US 8,942,406 B2
(45) Date of Patent: Jan. 27, 2015

(54) CANAL-TYPE RECEIVER

(76) Inventor: Isamu Koizumi, Tokyo (JP)

( * ) Notice: Subject to any disclaimer, the term of this patent is extended or adjusted under 35 U.S.C. 154(b) by 0 days.

(21) Appl. No.: 14/129,976

(22) PCT Filed: Jul. 4, 2012

(86) PCT No.: PCT/JP2012/067132

§ 371 (c)(1),
(2), (4) Date: Dec. 29, 2013

(87) PCT Pub. No.: WO2013/005784

PCT Pub. Date: Jan. 10, 2013

(65) Prior Publication Data

US 2014/0193022 A1 Jul. 10, 2014

(30) Foreign Application Priority Data

Jul. 5, 2011 (JP) ..... 2011/160315

(51) Int. Cl.
*H04R 1/10* (2006.01)
*H04R 1/34* (2006.01)
(Continued)

(52) U.S. Cl.
CPC ..... *H04R 1/1091* (2013.01); *H04R 25/656* (2013.01); *H04R 1/1016* (2013.01);
(Continued)

(58) Field of Classification Search
CPC ..... H04R 1/10; H04R 1/1016; H04R 1/32; H04R 1/326; H04R 1/34; H04R 1/345; H04R 25/02; H04R 25/40; H04R 25/402; H04R 25/60; H04R 25/604; H04R 25/606; H04R 25/608; H04R 25/65; H04R 25/652; H04R 25/654; H04R 25/656; H04R 2225/023; H04R 2225/025; H04R 1/1075; H04R 1/403; H04R 1/1091
USPC ..... 381/313, 322, 325, 328, 329, 335, 336, 381/338, 370, 371, 374, 379, 380, 382, 387, 381/395; 181/129–131, 133, 135, 136; 128/864
See application file for complete search history.

(56) References Cited

U.S. PATENT DOCUMENTS 8,201,561 B2 * 6/2012 Blanchard ..... 128/864
2008/0170738 A1 * 7/2008 Hope et al. ..... 381/371
(Continued)

FOREIGN PATENT DOCUMENTS

JP 08-008717 B2 1/1996
JP 08-009490 A 1/1996
(Continued)

OTHER PUBLICATIONS

Suzuki Keiichirou, Reason for Refusal, Office Action against JP2011-160315 application issued on Dec. 5, 2011 (After the Priority Date).
(Continued)

*Primary Examiner* — Curtis Kuntz
*Assistant Examiner* — Joshua A Kaufman
(74) *Attorney, Agent, or Firm* — International Knowledge Asset Office; Keiji Masaki

(57) ABSTRACT

An object of this invention is to provide a canal-type receiver capable of reproducing sound fields spanning front-to-rear and/or top-to-bottom. Thus, an ear piece of the canal-type receiver has a substantially cylindrical shape and includes a cylindrical portion including a sound guiding tube emitting a sound wave, radiated from a sound-emission unit in a receiver, to the inside of the external auditory canal, the sound guiding tube is configured so that a directional sound wave radiation axis of the sound wave faces a predetermined position of a wall of the external auditory canal in such a state that a cylindrical portion of the ear piece is mounted at a predetermined position in the external auditory canal, whereby the sound wave radiated from the sound guiding tube is reflected by a portion of the external auditory canal wall to arrive at the eardrum.

18 Claims, 15 Drawing Sheets

(51) Int. Cl.
*H04R 25/00* (2006.01)
*H04R 1/40* (2006.01)

(52) U.S. Cl.
CPCV ..... *H04R 1/1075* (2013.01); *H04R 1/345* (2013.01); *H04R 1/403* (2013.01)
USPC ..... 381/380; 381/325; 381/328; 381/382; 381/387; 181/130; 181/135

(56) References Cited

U.S. PATENT DOCUMENTS

| | | | | |
|---|---|---|---|---|
| 2011/0255723 | A1* | 10/2011 | Obradovic et al. | 381/328 |
| 2012/0128192 | A1* | 5/2012 | Burgett et al. | 381/380 |
| 2013/0294630 | A1* | 11/2013 | Matsuo et al. | 381/328 |
| 2013/0294635 | A1* | 11/2013 | Matsuo et al. | 381/380 |
| 2013/0343595 | A1* | 12/2013 | Zorkendorfer et al. | 381/380 |

FOREIGN PATENT DOCUMENTS

| | | | |
|---|---|---|---|
| JP | 2000-78698 | A | 3/2000 |
| JP | 2005-117594 | A | 4/2005 |
| JP | 2006-222962 | A | 8/2006 |
| JP | 2008-283398 | A | 11/2008 |
| JP | 3154041 | U | 9/2009 |
| JP | 2011-61725 | A | 3/2011 |

OTHER PUBLICATIONS

Igarashi Sadaki, Response to Office Action Issued by JPO Examiner Mr. Naoki Tomizawa acting as a part of International Search Organization dated on Aug. 7, 2012 (After the Priority Date).

* cited by examiner

CANAL-TYPE RECEIVER

TECHNICAL FIELD

The present invention relates to a canal-type receiver and is suitable for, for example, earphones, headphones, surround headphones, noise canceling headphones, a receiver for a game machine, a receiver for a television, a receiver for a mobile communication equipment, a hearing aid, stethoscopes including an electronic stethoscope, an acoustic equipment used in an aircraft, and a portable acoustic equipment.

BACKGROUND ART

A receiver is used in a lot of hearing equipment for listening to sounds. In headphones, a receiver is incorporated in a cover formed to cover the ears, and there have been known an intra-concha type (also referred to as an inner ear type) receiver used by inserting a receiver into the ear concha and a canal-type receiver used by inserting an ear piece of a receiver directly into the external auditory canal. Receivers of a type used by being inserted into the ears like the intra-concha type receiver and the canal-type receiver are collectively referred to as an inner type receiver. Those receivers are used in a telephone set such as a mobile telephone and a hearing aid in which a sound collected from a microphone is electrically amplified and thereafter transmitted to the eardrum by a receiver. In the receiver, a sound-emitter such as a speaker is stored in a housing, and the receiver is used by radiating a sound wave from the sound-emitter to the auricle, the opening of the external auditory canal, or inside the external auditory canal. When the canal-type receiver is used, an ear piece is required. Regarding headphones, documents concerning headphones utilizing the functions of the auricle are seen here and there.

In the prior art canal-type receiver, there is a problem that monaural hearing (that is hearing in one ear and also referred to as monotic hearing) is not clear and unnatural.

Meanwhile, in binaural hearing, it cannot be said that such a problem of such "lateralization" that sound is produced in the head is solved. Further, a receiver capable of identifying sound from above and sound from below has not been provided.

Patent Documents 1 and 2 disclose proposals for solving the problem of "lateralization".

CITATION LIST

Patent Documents

Patent Document 1: JP 2006-222962 A
Patent Document 2: JP 2005-117594 A

SUMMARY OF THE INVENTION

Problem to be Solved by the Invention

An object of the present invention is to provide a canal-type receiver, which can identify front and back sound by using a canal-type receiver capable of replaying sound fields over front and back even only in monaural hearing, can realize clear and natural hearing, and solves a problem of lateralization in binaural hearing, and a canal-type receiver which can identify front and back sound even only in monaural hearing and can reproduce the sound field over upward, downward, forward, and backward.

Solution to Problem

The present invention is related to a canal-type receiver including an ear piece used while being inserted into the external auditory canal, and the above-described object of the present invention is achieved by the canal-type receiver wherein the ear piece has a substantially cylindrical shape and includes a cylindrical portion including a sound guiding tube emitting a sound wave, radiated from a sound-emission unit in the receiver, into the external auditory canal, and the sound guiding tube is configured that a directional sound wave radiation axis of the sound wave faces a predetermined position of a wall of the external auditory canal (hereinafter referred to as a "external auditory canal wall") in such a state that the cylindrical portion of the ear piece is mounted at a predetermined position in the external auditory canal, whereby the sound wave radiated from the sound guiding tube is reflected by a portion of the external auditory canal wall to be arrived at the eardrum, thereby to have a sound image localized to forward, backward, upward or downward.

Additionally, the above object of the present invention is achieved by the canal-type receiver described above, wherein a substantially cylindrical housing sound guiding tube emitting sound from a front end projectingly provided on a front surface of a housing of the sound-emission unit is a sound guiding tube in the ear piece.

Further, the above object of the present invention is effectively achieved by the canal-type receiver described above, wherein the directional sound wave radiation axis of the sound guiding tube is configured to face a side wall on the front head side in the external auditory canal.

Still further, the above object of the present invention is further effectively achieved by the canal-type receiver described above, including: a second sound guiding tube provided in the ear piece; and a second sound-emission unit radiating the sound wave to the second sound guiding tube, wherein the directional sound wave radiation axis of the second sound guiding tube is configured to face a side wall on the back head side in the external auditory canal.

Even further, the above object of the present invention is also achieved by the canal-type receiver described above, including: an ear piece having a plurality of the sound guiding tubes described above; and a plurality of sound-emission units connected to each of the sound guiding tubes, wherein the directional sound wave radiation axes of the sound guiding tubes are configured to face different directions in the external auditory canal.

The above object of the present invention is achieved by the canal-type receiver described above, wherein a sound guiding tube sound-emitter constituted of the shortest sound guiding tube of the sound guiding tubes and a sound-emission unit connected to the sound guiding tube is used for direct sound, the directional sound wave radiation axis of the shortest sound guiding tube is configured to face a side wall on the front head side in the external auditory canal, all sound guiding tube sounding bodies other than the sound guiding tube sound-emitter for direct sound are used for indirect sound, and the directional sound wave radiation axes of the sound guiding tube sounding bodies for indirect sound face different external auditory canal wall portions other than the side wall on the front head side.

Additionally, the present invention is related to an ear piece used in the canal-type receiver, and the above-described object of the present invention is achieved by a canal-type receiver wherein the ear piece has a substantially cylindrical shape and includes a sound guiding tube, and the sound guiding tube is configured so that the directional sound wave radiation axis of the sound wave faces a predetermined position in the external auditory canal wall in such a state that the ear piece is mounted at a predetermined position in the external auditory canal.

Additionally, the above object of the present invention is achieved by the ear piece described above, wherein the directional sound wave radiation axis of the sound guiding tube is configured to face the side wall on the front head side in the external auditory canal.

Further, the above object of the present invention is effectively achieved by the ear piece described above including a second sound guiding tube, wherein the directional sound wave radiation axis of the second sound guiding tube is configured to face the side wall on the back head side in the external auditory canal.

Still further, the above object of the present invention is effectively achieved by the ear piece described above, including second and third sound guiding tubes, wherein the directional sound wave radiation axis of the second sound guiding tube is configured to face an upper side wall in the external auditory canal, and the directional sound wave radiation axis of the third sound guiding tube is configured to face a lower side wall in the external auditory canal.

Even further, the above object of the present invention is achieved by the ear piece describe above, including third and fourth sound guiding tubes, wherein the directional sound wave radiation axis of the third sound guiding tube is configured to face an upper side wall in the external auditory canal, and the directional sound wave radiation axis of the fourth sound guiding tube is configured to face a lower side wall in the external auditory canal.

Effects of the Invention

According to a preferred embodiment of the canal-type receiver according to the present invention, a sound field over forward and backward or upward and downward can be reproduced even only in monaural hearing, whereby front and back sound or upper and lower sound can be identified, and, at the same time, clear and natural hearing can be realized. Further, in binaural hearing, localization is allowed.

BRIEF DESCRIPTION OF THE DRAWINGS

FIG. 5 is a head side cross-sectional view showing a state in which the canal-type receiver according to the present invention is inserted into the external auditory canal.

FIG. 6 is a head side longitudinal cross-sectional view showing a state in which the canal-type receiver according to the present invention is inserted into the external auditory canal.

DESCRIPTION OF EMBODIMENTS

A sound-emitter used in a canal-type receiver of the present invention includes a speaker or other electro-acoustic transducer.

In the present application, a substantially cylindrical sound guiding tube for sound wave radiation provided in a housing storing a sound-emitter is referred to as a housing sound guiding tube, and a sound-emitter stored in a housing having the housing sound guiding tube is referred to as a sound-emission unit. An earpiece to be described below is an ear piece having a tube fitted into the housing sound guiding tube or a cylindrical portion buried with a sound guiding tube and may have, outside the cylindrical portion, an umbrella-shaped portion coupling to one end side of the cylindrical portion and extending in the form of an umbrella to cover the cylindrical portion. Unless otherwise specified, all cross-sectional views of the ear piece of a receiver according to the present invention and the receiver are cross-sectional views seen from above, and the front views are front views seen from the eardrum side.

Figure 1:
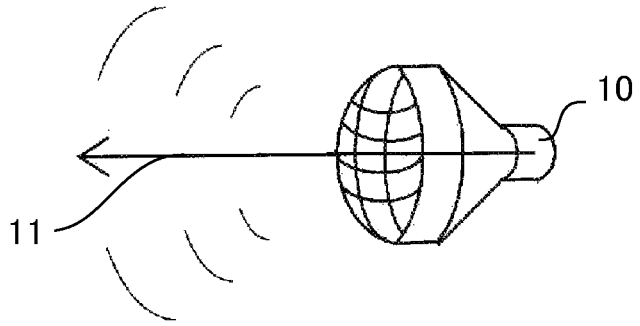
FIG. 1 is a view for explaining a concept of a sound wave radiation axis.

FIG. 1 is a view for explaining a concept of a sound wave radiation axis. When an example of the sound wave radiation axis is shown when a speaker is used as a sound-emitter, an axis connecting a center of a sound-emitter 10 converting a sound electrical signal into a sound wave and a center of the sound wave in a traveling direction of a generated sound wave is referred to as a sound wave radiation axis 11, and the arrow shows a direction that the sound wave travels.

Figure 2:
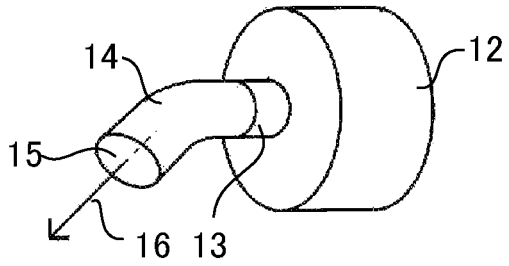
FIG. 2 is a view for explaining a housing sound guiding tube, a sound guiding tube, and a sound wave radiation cross section.

FIG. 2 is a view for explaining a housing sound guiding tube, a sound guiding tube, and a sound wave radiation cross section. FIG. 2 shows a state in which a housing sound guiding tube 13 is connected to a sound-emission unit 12, and a sound guiding tube 14 is further connected to the housing sound guiding tube 13, and a cross section on the side where the sound wave of the sound guiding tube 14 is radiated is referred to as a sound wave radiation cross section 15. A complex in which one sound guiding tube is connected to one sound-emission unit is hereinafter referred to as a sound guiding tube sound-emitter. In this drawing, although the sound guiding tube 14 is bent, reference numeral 16 is a sound wave radiation axis of a sound guiding tube sound-emitter in which the sound guiding tube 14 is bent and is an axis vertical with respect to the sound wave radiation cross section 15 from the center of the sound wave radiation cross section 15. In this example, an umbrella portion of an ear piece of the sound guiding tube 14 connected to the housing sound guiding tube 13 is omitted for ease of understanding.

Figure 3:
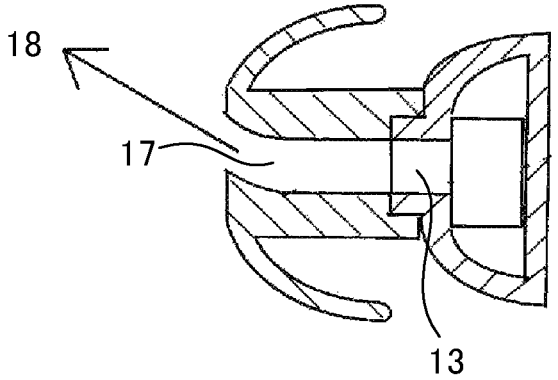
FIG. 3 is a view showing an example of a schematic cross-sectional view of a canal-type receiver according to the present invention.

FIG. 3 is a schematic cross-sectional view of an example of a canal-type receiver which is a portion of the present invention. In the canal-type receiver, in the canal-type receiver provided with a sound guiding tube 17 in an ear piece cylindrical portion fitted and connected (hereinafter referred to as "connected") to the housing sound guiding tube 13, since the housing sound guiding tube 13, the sound guiding tube 17 in the ear piece cylindrical portion and the sound guiding tube 14 connected to the housing sound guiding tube 13 have the same function, these sound guiding tubes are collectively referred to as in-tube sound guiding tubes. An axis connecting the center of a sound wave radiation cross section 15 of the in-tube sound guiding tube and the center of the sound wave in the traveling direction of a generated sound wave is referred to as a sound guiding tube wave radiation axis 18.

The arrow shows a direction that the sound wave travels. Hereinafter, since both the sound wave radiation axis and the sound guiding tube sound wave radiation axis show the sound wave radiation directions, they are collectively referred to as a directional sound wave radiation axis.

Figure 4A:
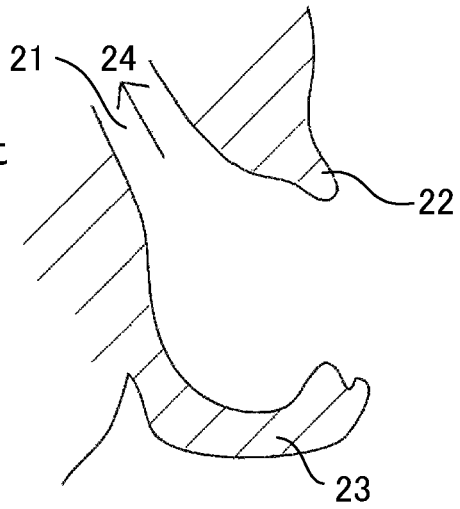
FIG.4A Prior Art
FIG. 4A is a head side cross-sectional view on an external auditory canal surface.
Figure 4B:
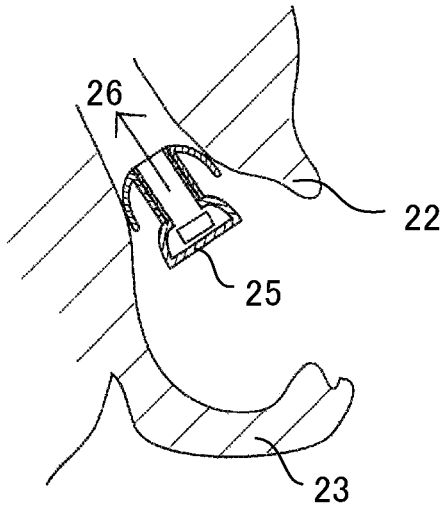
FIG.4B Prior Art
FIG. 4B is a view showing a state in which a conventional canal-type receiver is inserted into the external auditory canal.

FIG. 4 is a head side cross-sectional view on an external auditory canal surface (FIG. 4A) and is a view showing a state in which a conventional canal-type receiver is inserted into the external auditory canal (FIG. 4B). In FIG. 4A, reference numeral 21 is the external auditory canal, reference numeral 22 is the tragus, reference numeral 23 is the auricle, and reference numeral 24 is a central axis of the external auditory canal 21. FIG. 4B is a view showing a state in which a front end of an ear piece of a conventional canal-type receiver 25 is inserted into the external auditory canal 21, and a central axis 24 of the external auditory canal and a central axis 26 of the ear piece (which is namely equal to the directional sound wave radiation axis of a sound-emission unit of the conventional canal-type receiver 25) are parallel to each other.

FIG. 5 is a head side cross-sectional view showing a state in which the canal-type receiver 27 according to the present invention is inserted into the external auditory canal.

Namely, when the canal-type receiver 27 according to the present invention is inserted into the external auditory canal, there is provided such a structure that the sound wave is radiated while a directional sound wave radiation axis 26 of the sound-emission unit of the canal-type receiver 27 faces a portion of a side wall of the external auditory canal so that the central axis 24 of the external auditory canal and the directional sound wave radiation axis 26 of the sound-emission unit of the canal-type receiver 27 are not parallel to each other. Reference numeral 28 is an in-tube sound guiding tube.

When the sound wave is radiated so that the directional sound wave radiation axis of the sound-emission unit faces a portion of an external auditory canal wall, the difference arises in a method of transmitting the sound wave to the eardrum according to a difference of a portion of the external auditory canal wall to which the sound wave is radiated, and it is found that the difference is the information of an arrival direction of the sound as one of sound information. Namely, when the sound wave is radiated so that the directional sound wave radiation axis faces a different portion in the external auditory canal wall, the sound wave can be perceived as the sound wave arrived from a different direction, and as a result, it is found that enhancement of sound quality is achieved. This is a discovery of a new external auditory canal function. It seems that once the sound wave is reflected on the external auditory canal wall, the sound wave is efficiently arrived at the eardrum, so that the sound quality is enhanced.

Figure 5A:
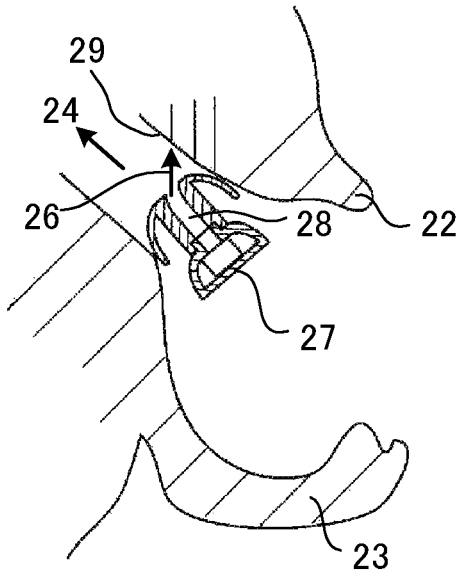
FIG. 5A is a view showing a receiver for forward localization.
Figure 5B:
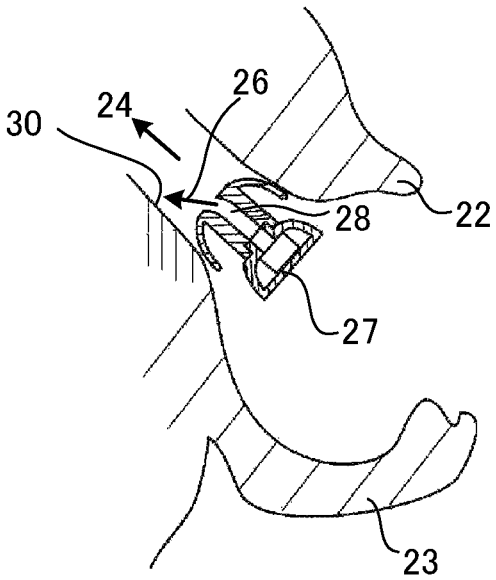
FIG. 5B is a view showing an example in which a receiver for backward localization is inserted.

In FIG. 5, as shown in FIG. 5A, in the canal-type receiver, when the sound wave is radiated so that the directional sound wave radiation axis 26 of the sound-emission unit faces a side wall 29 on the front head side of the external auditory canal in such a state that the front end of the ear piece is inserted into the external auditory canal, the sound wave can be perceived as front sound, and meanwhile, as shown in FIG. 5B, when the sound wave is radiated so that the directional sound wave radiation axis 26 of the sound-emission unit faces a side wall 30 on the back head side of the external auditory canal, the sound wave can be perceived as back sound. The side wall 29 on the front head side of the external auditory canal referred to herein means a side wall on the nose side of the external auditory canal, and the side wall 30 on the back head side of the external auditory canal means a side wall on the back head side of the external auditory canal means. As described below, the receiver of FIG. 5A is referred to as a forward localization receiver, and the receiver of FIG. 5B is referred to as a backward localization receiver.

Figure 6A:
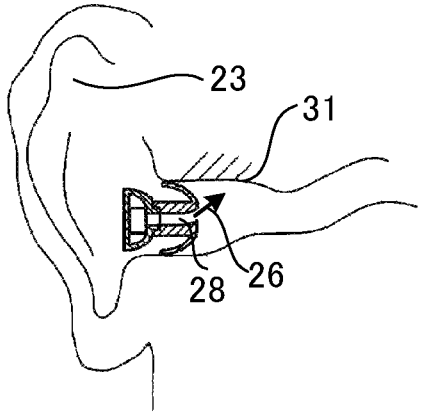
FIG. 6A is a view showing an example in which a receiver for upper localization.
Figure 6B:
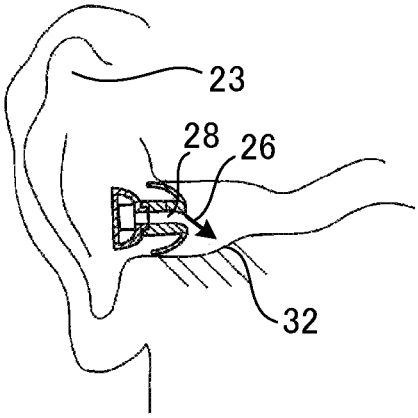
FIG. 6B is a view showing an example in which a receiver for lower localization is inserted.

FIG. 6 is a longitudinal cross-sectional view of the head in an external auditory canal portion, and the following facts were found out: when the sound wave is radiated while the directional sound wave radiation axis 26 faces an upper wall 31 of the external auditory canal as shown in FIG. 6A, the sound wave is perceived as sound from above, and when the sound wave is radiated while the directional sound wave radiation axis 26 faces a lower wall 32 of the external auditory canal as shown in FIG. 6B, the sound wave is perceived as sound from below. Reference numeral 28 is an in-tube sound guiding tube, and reference numeral 23 is the auricle.

As shown in the longitudinal cross-sectional surface in the external auditory canal of FIG. 6, a receiver of a system using a sound-emission unit in which the sound wave is radiated while the directional sound wave radiation axis 26 of the sound-emitter of FIG. 6A faces the upper wall 31 of the external auditory canal in the external auditory canal portion into which the front end of the ear piece is inserted is hereinafter referred to as an upper localization receiver, and a receiver of a system using a sound-emission unit in which the sound wave is radiated while the directional sound wave radiation axis 26 of the sound-emitter faces the lower wall 32 of the external auditory canal in the external auditory canal portion into which the front end of the ear piece is inserted is hereinafter referred to as a lower localization receiver.

Accordingly, in the structure of the canal-type receiver using an ear piece in which an in-tube sound guiding tube is arranged so that the sound wave is radiated while the directional sound wave radiation axis of the sound-emission unit faces a predetermined external auditory canal wall portion, the canal-type receiver capable of hearing the sound wave as the sound arrived from a desired direction can be provided. Accordingly, in a sound hearing device in which the sound guiding tube is inserted in the external auditory canal to transmit the sound wave to the eardrum, when the sound wave is radiated while the directional sound wave radiation axis of the in-tube sound guiding tube faces a predetermined external auditory canal wall, a sound hearing device and a receiver capable of hearing the sound wave as the sound arrived from a desired direction can be provided.

As described above, the directional sound wave radiation axis of the sound-emission unit is radiated to a portion of the external auditory canal wall, whereby the direction of the arrived sound is perceived, and localization is performed. Further, an effect allowing high quality hearing superior in rising is obtained. Furthermore, since hearing in the sound field in a wider space can be realized by forward localization rather than lateralization, an effect of enhancing localization resolution performance is obtained.

The ear piece in which the sound guiding tube is arranged in the ear piece so that the sound wave is radiated while the directional sound wave radiation axis of the sound guiding tube in the ear piece faces the side wall on the front head side of the external auditory canal in the external auditory canal portion into which the front end of the ear piece is inserted is hereinafter referred to as a forward sound ear piece.

A receiver in which the sound-emission unit is connected to the front sound ear piece is hereinafter referred to as a forward localization receiver, and when the receivers are used a pair of left and right receivers, the pair of the receivers is a forward-localized canal-type receiver for a stereo. When not the sound guiding tube in the ear piece but an extended housing sound guiding tube is used to substitute for the sound guiding tube in the front sound ear piece, a similar effect is obtained. Meanwhile, the ear piece in which the sound guiding tube in the ear piece is arranged so that the sound wave is radiated while the directional sound wave radiation axis of the sound guiding tube in the ear piece faces the side wall on the back head side of the external auditory canal in the external auditory canal portion into which the front end of the ear piece is inserted is hereinafter referred to as a back sound ear piece, and a receiver in which the sound-emission unit is connected to the back sound ear piece is hereinafter referred to as a backward localization receiver. In a receiver provided with the forward localization receiver and the backward localization receiver, the front and back sound fields can be reproduced.

In a receiver using an ear piece, two sound guiding tubes including a first sound guiding tube and a second sound guiding tube are provided in the ear piece, and an ear piece in which the first sound guiding tube is arranged in the ear piece so that the sound wave is radiated while the directional sound wave radiation axis of the first sound guiding tube faces a side wall on the front head side of the external auditory canal in the external auditory canal portion into which the front end of the ear piece is inserted and the second sound guiding tube is arranged in the ear piece so that the sound wave is radiated while the directional sound wave radiation axis of the second sound guiding tube faces a side wall of the back head side of the external auditory canal in the external auditory canal portion into which the front end of the ear piece is inserted is referred to as a front and back sound ear piece. The sound-emission unit storing the first sound-emitter is a first sound-emission unit, and a housing sound guiding tube of the first sound-emission unit and the first sound guiding tube are connected. The sound-emission unit storing the second sound-emitter is a second sound-emission unit, and a housing sound guiding tube of the second sound-emission unit and the second sound guiding tube are connected, and a receiver in which they are combined is a front and back sound field reproduction receiver capable of identifying front and back sound. This receiver is hereinafter referred to a front and back sound field receiver. In this case, the first sound-emission unit is a sound-emission unit taking charge of front sound, and the second sound-emission unit is a sound-emission unit taking charge of back sound. Hereinafter, the sound-emission unit taking charge of front sound is referred to as a front sound-emission unit, and the sound-emission unit taking charge of back sound is referred to as a back sound-emission unit. When the front and back sound field receiver is used, even in monaural hearing in which the sound is heard by a receiver used only in one ear, a receiver in which the front and back sound fields can be reproduced is obtained.

As an alternative to the first and second sound guiding tubes in the ear piece, when the housing sound guiding tube of the sound-emission unit is extended to be used to substitute for the first or second sound guiding tube in the ear piece, a similar effect is obtained. The second sound guiding tube in the ear piece is made longer than the first sound guiding tube, and when the sound wave from the sound-emission unit connected to the second sound guiding tube is delayed to be arrived at the eardrum, an indirect sound effect is obtained in the sound wave radiated from the second sound guiding tube, and the forward localization becomes clearer, so that the resolution performance is enhanced. For example, it is useful for securement of a delay time to form a portion of the second sound guiding tube into a coil shape and elongate a tube path.

Figure 7A:
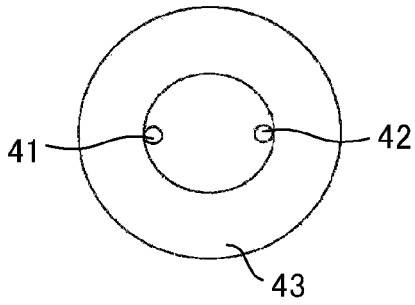
FIG. 7A is a view showing a front view of a front and back sound field receiver for a right ear seen from the eardrum side.

Hereinafter, as an embodiment for practicing the present invention with reference to the drawings, a canal-type front and back sound field receiver will be described. FIG. 7A is a front view in which an ear piece for a right ear inserted into the external auditory canal is seen from the eardrum side, reference numeral 41 is a sound wave radiation opening for front sound, reference numeral 42 is a sound wave radiation opening for back sound, and reference numeral 43 is an umbrella-shaped portion of the ear piece.

Figure 7B:
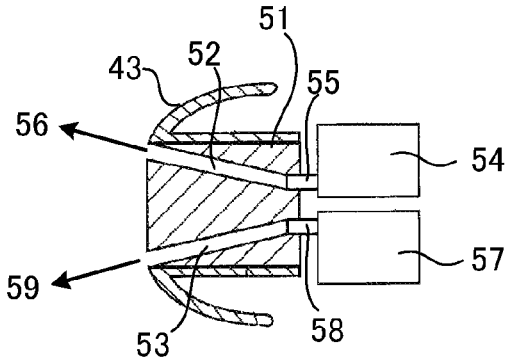
FIG. 7B is a view showing a cross section of the front and back sound field receiver for a right year.

FIG. 7B shows a schematic cross-sectional view of the canal-type front and back sound field receiver for a right ear, and two sound guiding tubes including a first sound guiding tube 52 and a second sound guiding tube 53 are arranged in an ear piece cylindrical portion 51. The first sound guiding tube 52 is connected as a sound guiding tube for front sound to a housing sound guiding tube 55 of a forward sound-emission unit 54 and is arranged in the ear piece while a directional sound wave radiation axis 56 on a sound wave radiation end surface of the sound guiding tube for front sound faces the external auditory canal wall on the front head side of the external auditory canal in such a state that the ear piece is inserted into the external auditory canal. The second sound guiding tube 53 is connected as a sound guiding tube for back sound to a housing sound guiding tube 58 of a backward sound-emission unit 57 and is arranged in an ear piece cylindrical portion while a directional sound wave radiation axis 59 on a sound wave radiation end surface of the sound guiding tube for back sound faces the external auditory canal wall on the back head side of the external auditory canal in such a state that the ear piece is inserted into the external auditory canal.

Those housing sound guiding tubes may be extended to be used to substitute for the first and second sound guiding tubes.

Figure 7C:
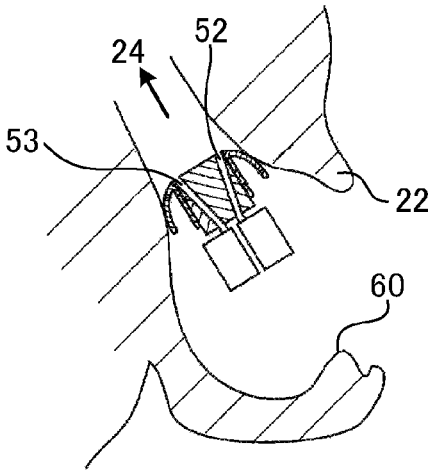
FIG. 7C is a view showing a cross-sectional view of the external auditory canal in which the front and back sound field receiver for a right ear is mounted.

FIG. 7C is a cross-sectional view in which the front and back sound field receiver is mounted in the external auditory canal. Reference numeral 24 is a central axis of the external auditory canal, reference numeral 22 is the tragus, reference numeral 60 is the anthelix, reference numeral 52 is an in-tube sound guiding tube for front sound, and reference numeral 53 is an in-tube sound guiding tube for back sound.

Figure 7D:
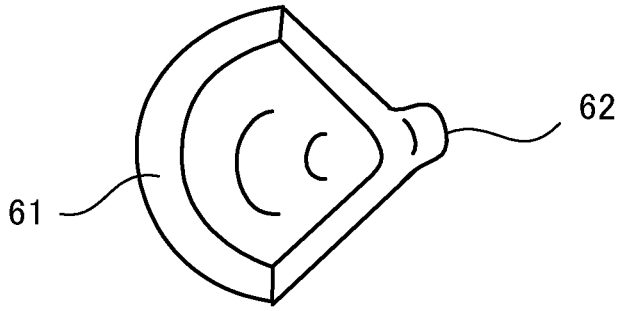
FIG. 7D is a view showing a schematic diagram of a shape of a cavity of a phone-shaped sound guiding tube.
Figure 7E:
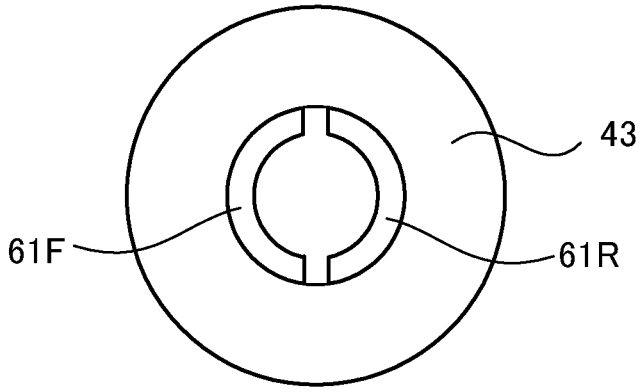
FIG. 7E is a front view of a sound wave radiation opening of the phone-shaped sound guiding tube of FIG. 7D seen from the eardrum side.

The shape of a cavity of the in-plane sound guiding tube may be a phone shape opening on a sound wave radiation end surface. FIG. 7D shows a perspective view of an example of a cavity of the phone-shaped in-tube sound guiding tube. Reference numeral 61 is a sound wave radiation end surface, reference numeral 62 is a connection end cavity connected to the sound-emission unit. FIG. 7E is a front view of an ear piece for a right ear when the shape of the cavity of the in-tube sound guiding tube is a phone shape. Reference numeral 61F is a sound wave radiation end surface for front sound, reference numeral 61R is a sound wave radiation end surface for back sound, and reference numeral 43 is an umbrella portion of the ear piece.

When the front and back sound field receiver is used as a pair of left and right receivers, the pair of the receivers is used as headphones for surround reproduction using the canal-type receivers.

Figure 8A:
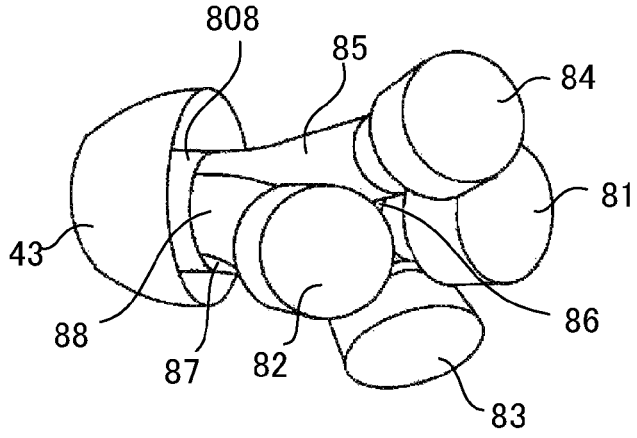
FIG. 8A is a schematic perspective view of upper, lower, and front, and back sound field receiver for a right ear.
Figure 8B:
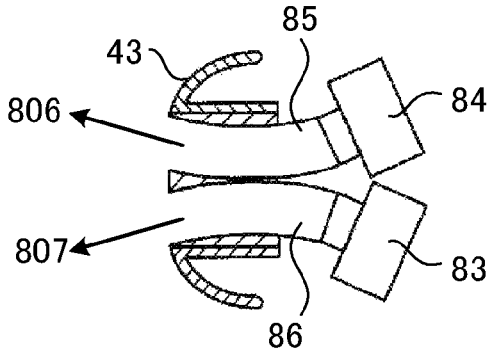
FIG. 8B is a schematic diagram of a longitudinal cross section of a upper and lower sound guiding tube.
Figure 8C:
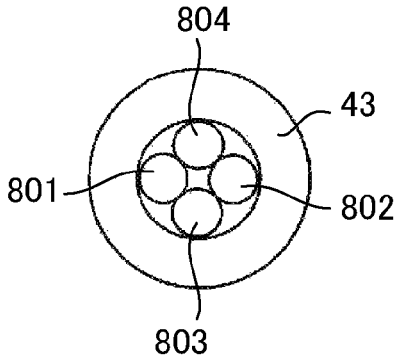
FIG. 8C is a front view seen from the eardrum side.

When two kinds of sound-emission units constituting the upper localization receiver and the lower localization receiver is added to the front and back sound field receiver, the upper, lower, front, and back sound fields can be distinguished from each other. FIG. 8A shows a schematic perspective view of an upper, lower, front, and back sound field receiver for a right ear, and FIG. 8B shows a schematic view of a longitudinal cross section of only upper and lower sound guiding tubes, while front and back sound guiding tubes are omitted for ease of understanding. The upper, lower, front, and back sound field receiver is constituted of four sound-emission units including a second sound-emission unit 81 as the forward sound-emitter, a fourth sound-emission unit 82 as the backward sound-emitter, a first sound-emission unit 84 as a sound-emitter for upper sound, and a third sound-emission unit 83 as a sound-emitter for lower sound. In the front and back sound field receiver shown in FIG. 7B, two sound guiding tubes including a high-order sound guiding tube 85 and a low-order sound guiding tube 86 vertically arranged up and down are further added in the ear piece, and the high-order sound guiding tube 85 as a sound guiding tube for upper sound is connected to the first sound-emission unit 84 for upper sound. A directional sound wave radiation axis 806 of the sound-emitter for upper sound faces an upper wall of the external auditory canal into which the ear piece is inserted, and the other added lower sound guiding tube 87 is connected as a sound guiding tube for lower sound to the sound-emission unit 83 for lower sound. A directional sound wave radiation axis 807 of the sound-emitter for lower sound faces a lower wall of the external auditory canal into which the ear piece is inserted and is arranged in an ear piece cylindrical portion. FIG. 8C shows a front view of a right upper, lower, front, and back sound field receiver seen from the eardrum side. Reference numeral 801 is a front sound radiation opening, reference numeral 802 is a back sound radiation opening, reference numeral 803 is a lower sound radiation opening, reference numeral 804 is an upper sound radiation opening, and reference numeral 43 is an umbrella-shaped portion of the ear piece.

FIG. 8A is a schematic view of an ear piece for a right ear in which the four sound guiding tubes including a first sound guiding tube 85, a second sound guiding tube 86, a third sound guiding tube 87, and a fourth sound guiding tube 88 are arranged in an ear piece cylindrical portion 808 and four sound-emission units (81 to 84) are connected to the four sound guiding tubes. FIG. 8A shows the ear piece having a configuration of a cylindrical portion in which the four sound guiding tubes are arranged so that the sound guiding tube sound wave radiation axis of the first sound guiding tube faces an upper wall of the external auditory canal, the sound guiding tube sound wave radiation axis of the second sound guiding tube faces a side wall on the front head side of the external auditory canal, the sound guiding tube sound wave radiation axis of the third sound guiding tube faces a lower wall of the external auditory canal, and the sound guiding tube sound wave radiation axis of the fourth sound guiding tube faces a side wall of the back head side of the external auditory canal. This ear piece is hereinafter referred to an upper, lower, front, and back sound ear piece. In a receiver in which the first sound guiding tube is connected to the first sound-emission unit 84 storing the sound-emitter for upper sound, the second sound guiding tube is connected to the second sound-emission unit 81 storing the sound-emitter for front sound-emitter, the third sound guiding tube is connected to the third sound-emission unit 83 storing the sound-emitter for lower sound, and the fourth sound guiding tube is connected to the fourth sound-emission unit 82 storing the backward sound-emitter, this receiver is a receiver capable of identifying the direction of the sound arrived from the upper, lower, front, and back directions.

As an alternative to the in-tube sound guiding tube in the ear piece cylindrical portion, even when the housing sound guiding tube of the sound-emission unit is extended to be used to substitute for the first, second, third, or fourth sound guiding tube, a similar effect is obtained.

Figure 9A:
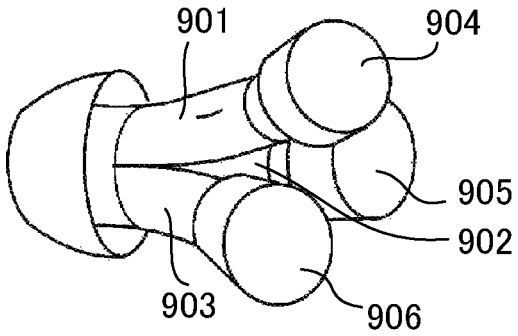
FIG. 9A and FIG. 9B are views showing an example of upper, lower, and front sound ear piece.
Figure 9B:
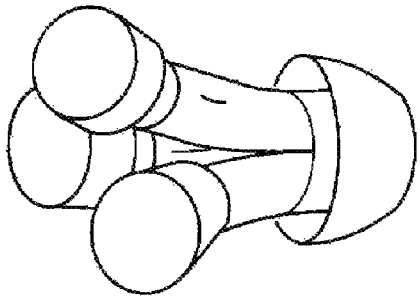

An ear piece simplified by omitting the fourth sound guiding tube of the upper, lower, front, and back sound ear piece and the sound-emission unit for back sound connected to the fourth sound guiding tube is referred to as an upper, lower, and front sound ear piece, and FIG. 9A shows a schematic perspective view of an upper, lower, and front sound ear piece for a right ear. Three sound guiding tubes including a first sound guiding tube 901, a second sound guiding tube 902, and a third sound guiding tube 903 are arranged in an ear piece cylindrical portion, and there is provided an ear piece in which the three sound guiding tubes are arranged in an ear piece cylindrical portion so that the sound guiding tube sound wave radiation axis of the first sound guiding tube faces an upper wall of the external auditory canal, the sound guiding tube sound wave radiation axis of the second sound guiding tube faces a side wall on the front head side of the external auditory canal, and the sound guiding tube sound wave radiation axis of the third sound guiding tube faces a lower wall of the external auditory canal. In a receiver in which the first sound guiding tube is connected to a sound-emission unit 904 storing the sound-emitter for upper sound, the second sound guiding tube is connected to a sound-emission unit 905 storing the forward sound-emitter, and the third sound guiding tube is connected to a sound-emission unit 906 storing the sound-emitter for lower sound, this receiver is an upper, lower, and front sound receiver for a right ear, which is capable of identifying the direction of the sound arrived from the upper, lower, and front directions. FIG. 9B shows an upper, lower, and front sound receiver for a left ear. Those receivers are hereinafter referred to as an upper, lower, and front sound field receivers. As an alternative to the sound guiding tube in the ear piece cylindrical portion, even when the housing sound guiding tube of each sound-emission unit is extended to be used to substitute for the first, second, or third sound guiding tube of the ear piece, a similar effect is obtained. As described above, the sound-emission unit storing the forward sound-emitter is the forward sound-emission unit, and the sound-emission unit storing the backward sound-emitter is the backward sound-emission unit.

The direct sound to be described below is sound input from a sound wave generation source of sound desired to be heard into the ear in the shortest time, and the indirect sound is the sound input into the ear to be more delayed than the direct sound after the sound wave from the sound wave generation source is once reflected by a surrounding environment object.

Figure 10:
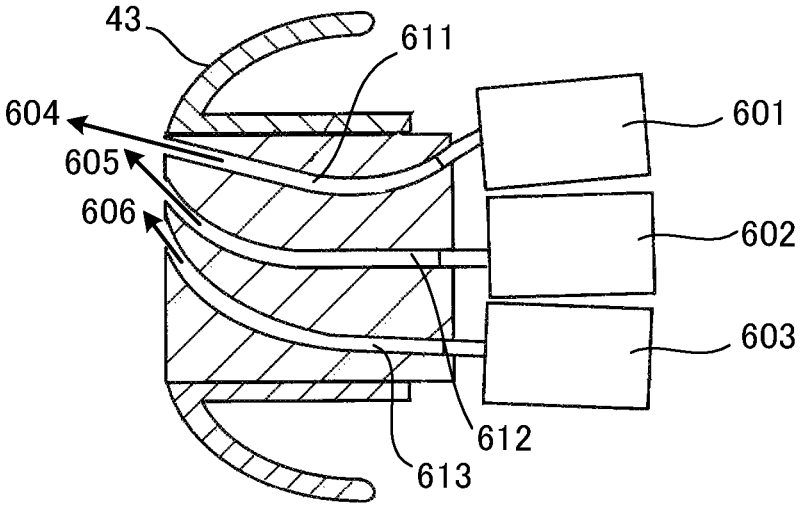
FIG. 10 is a cross-sectional view showing an example of a multi-channel receiver for a right ear.

In the canal-type receiver, N (N is an integer not less than 2) sound guiding tubes are provided in a cylindrical portion of an ear piece, and the incident angles of the directional sound wave radiation axes of the N sound guiding tubes in the ear piece to the external auditory canal side wall are made different, and N sound-emission units corresponding to the respective sound guiding tubes are connected, whereby sound source direction information from different directions of the same number as the sound guiding tubes in the ear piece cylindrical portion can be input to the eardrum. Namely, this receiver is an N-channel receiver capable of identifying N directions. FIG. 10 shows a schematic cross section of an example of forward three-channel receiver for a right ear when N=3. Reference numeral 601 is a sound-emission unit for a first channel, reference numeral 602 is a sound-emission unit for a second channel, reference numeral 603 is a sound-emission unit for a third channel, reference numerals 604, 605, and 606 are directional sound wave radiation axes, reference numeral 43 is an ear piece umbrella-shaped portion, reference numeral 611 is a sound guiding tube of the first channel, reference numeral 612 is a sound guiding tube of the second channel, and reference numeral 613 is a sound guiding tube of the third channel.

When the sound-emission unit connected to the shortest sound guiding tube of the N sound guiding tubes is used for the direct sound, and other sound-emission units are used for the indirect sound, forward-localized high-quality sound full of presence can be listened. The sound guiding tube sound wave radiation axis of the sound-emission unit for direct sound is arranged in an ear piece so that the ear piece radiates the sound wave toward the side wall of the front head side of the external auditory canal. In natural hearing, the direct sound desired to be heard and an infinite number of other indirect sounds are arrived from a large number of directions including upper, lower, left, right, front, and back directions, and the sound is input to the eardrum; therefore, it is possible to approach more natural hearing by increasing the number of N.

Among those sound-emission units, the sound-emission unit connected to the shortest sound guiding tube in the ear piece is a sound-emission unit for direct sound, and the sound-emission unit connected to the sound guiding tube other than the shortest sound guiding tube is a sound-emission unit taking charge of the indirect sound. When the sound-emission unit for indirect sound is driven by a voice signal obtained by delaying a voice signal driving the sound-emission unit for direct sound by a predetermined time, a receiver with a higher sound quality is obtained. In order to delay the voice signal, the sound guiding tubes connected to the sound-emission unit for indirect sound have various lengths, or a predetermined delay time is generated by an amplifier with a delay time generator, whereby the sound-emission unit for indirect sound may be driven. A delay time processor to be described below is a device for adjusting a signal level of an electrical signal and thereafter delaying the signal by a predetermined time. Further, a receiving device is a device including a receiver and an amplifier driving the receiver.

As described above, the forward sound-emitter is a sound-emitter taking charge of sound wave radiation for hearing of a sound source arrived from forward at the time of hearing, and the backward sound-emitter is a sound-emitter taking charge of sound wave radiation for hearing of a sound source arrived from backward at the time of hearing.

Similarly, the upper sound-emitter is a sound-emitter taking charge of sound wave radiation for hearing of a sound source arrived from above at the time of hearing, and the lower sound-emitter is a sound-emitter taking charge of sound wave radiation for hearing of a sound source arrived from below at the time of hearing.

Figure 11:
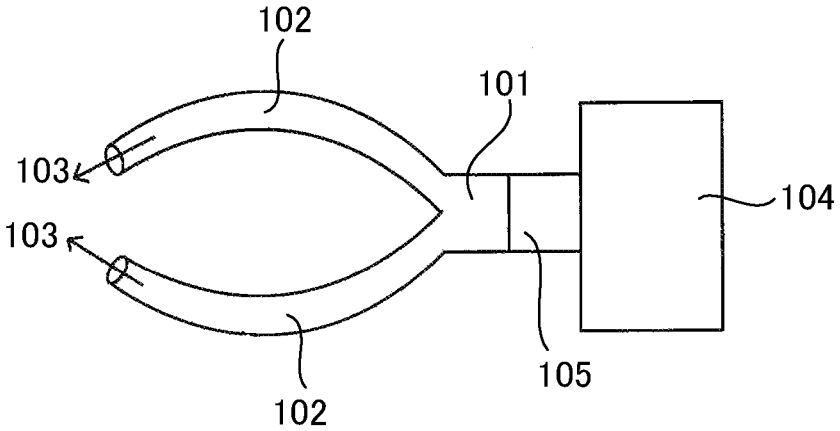
FIG. 11 is a view showing a relationship between a main sound guiding tube and a branched sound guiding tube.

A plurality of sound guiding tubes are connected to one sound-emission unit to form the sound wave radiation axes of the sound guiding tubes, or, as shown in FIG. 11, one sound guiding tube is connected to one sound-emission unit, this is referred to as a main sound guiding tube 101, and the main sound guiding tube is branched into a plurality of tubes. When the branched sound guiding tubes are referred to as branched sound guiding tubes 102, the branched sound guiding tubes are the sound guiding tubes, and therefore, it is found that each sound wave radiation axis of the branched sound guiding tubes has a function as an independent sound wave radiation axis. Reference numeral 104 is a sound-emission unit, and reference numeral 105 is a housing sound guiding tube. As shown in FIG. 11, the directional sound wave radiation axes 103 of the plurality of branched sound guiding tubes 102 may be arranged so that the sound wave is radiated to the targeted external auditory canal wall after the directional sound wave radiation axes 103 are crossed.

Hereinafter, the sound wave radiation axis 103 of the branched sound guiding tube is referred to as a branched sound guiding tube sound wave radiation axis, and the main sound guiding tube and the branched sound guiding tube are referred to as multi-branched sound guiding tubes. An ear piece provided with the multi-branched sound guiding tube in an ear piece cylindrical portion is referred to as a branched sound guiding tube ear piece. As an alternative to an in-tube sound guiding tube in the ear piece cylindrical portion, even when the housing sound guide 105 is extended to be used to substitute for the multi-branched sound guiding tube, a similar effect is obtained.

Figure 12A:
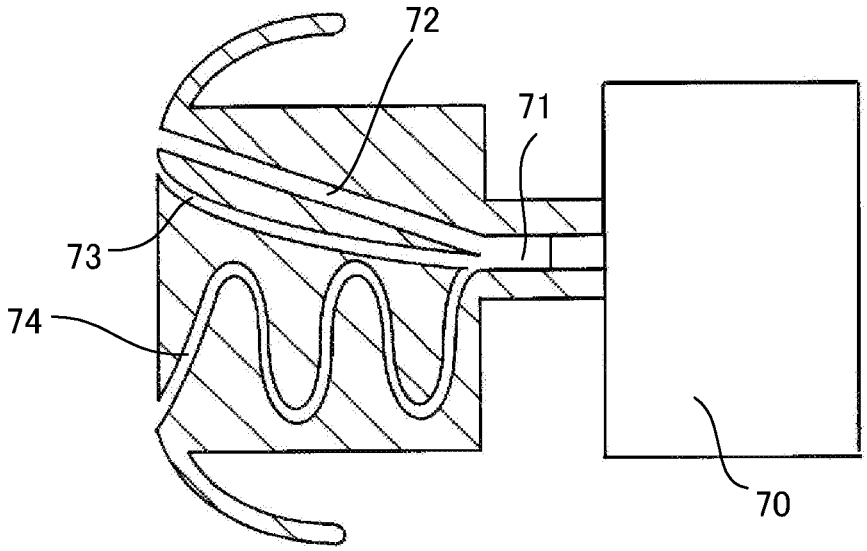
FIG. 12A is a view showing a schematic cross-sectional view of an example of a trifurcated sound guiding tube of a multiple sound wave radiation axis sound-emitter for a right ear.
Figure 12B:
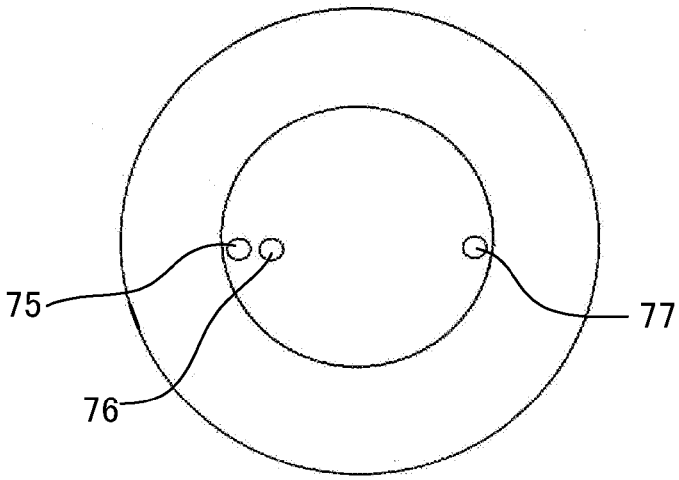
FIG. 12B is a view showing a front view of the multiple sound wave radiation axis sound-emitter for a right ear.

FIG. 12A shows a schematic cross-sectional view of a receiver using a multiple sound wave radiation axis sound-emission unit in which three branched sound guiding tubes are arranged in an ear piece cylindrical portion for a right ear. A sound-emission unit connected to a main sound guiding tube having a plurality of branched sound guide tubs is hereinafter referred to as a multiple sound wave radiation axis sound-emission unit. The sound wave radiation axes of three branched sound guiding tube branched from a main sound guiding tube 71 are arranged to form different incident angles to a sagittal plane. In this example, a sound guiding tube 72 having the shortest length is a sound guiding tube for direct sound contributing to the forward localization, and the sound guiding tube 72 is arranged in an ear piece cylindrical portion so that the directional sound wave radiation axis faces the external auditory canal wall on the front head side of the external auditory canal in such a state that the front end of the ear piece is inserted into the external auditory canal, and the other sound guiding tubes are arranged as the sound guiding tube for indirect sound so that the sound wave radiation axis faces the external auditory canal wall on the opposite side 74 of the same side 73 as the shortest branched sound guiding tube. Reference numeral 70 is a sound-emission unit. FIG.

12B is a front view of the ear piece shown in FIG. 12A seen from the eardrum side and shows sound wave radiation openings of the three branched sound guiding tubes. A direct-sound sound wave radiation opening 75, an indirect-sound sound wave radiation opening 76 on the same side as the direct sound, and an indirect-sound sound wave radiation opening 77 on the back head side on the opposite side of the direct sound. Accordingly, when the multiple sound wave radiation axis sound-emission unit is used as a receiver, a large number of sound wave information arrived from many directions can be input and transmitted to the eardrum, like a receiver having the sound wave radiation axis constituted of the sound-emission units of the same number as the branched sound guiding tubes.

When the branched sound guiding tubes have different lengths, the shortest branched sound guiding tube of the branched sound guiding tubes is used for direct sound. The branched sound guiding tube sound wave radiation axis faces the side wall on the front head side of the external auditory canal in the external auditory canal portion into which the front end of the ear piece is inserted and is arranged, and other branched sound guiding tube sound wave radiation axes are used for the indirect sound and arranged to face different external auditory canal walls. The branched sound guiding tube and the main sound guiding tube connected to this are referred to as a branched sound guiding tube ear piece for front sound. Meanwhile, an ear piece for direct sound in which the branched sound guiding tube sound wave radiation axis faces the side wall on the back head side wall on the external auditory canal in the external auditory canal portion into which the front end of the ear piece is inserted and is arranged is referred to as a branched sound guiding tube ear piece for back sound.

By virtue of the use of the branched sound guiding tube ear piece, even in one sound-emission unit, one direct sound and the indirect sounds from a large number of directions can be input to the eardrum by changing the lengths of the branched sound guiding tubes.

When the branched sound guiding tubes have different length, the sound wave radiation axes emitting sound from many directions and through a large number of delay times are generated in comparison with the sound-emission unit having no branched sound guiding tube. Therefore, in a receiver using the multiple sound wave radiation axis sound-emission unit, sound including a large number of indirect sounds can be heard, so that an effect capable of hearing three-dimensional high-quality sound superior in rising is produced.

Figure 13A:
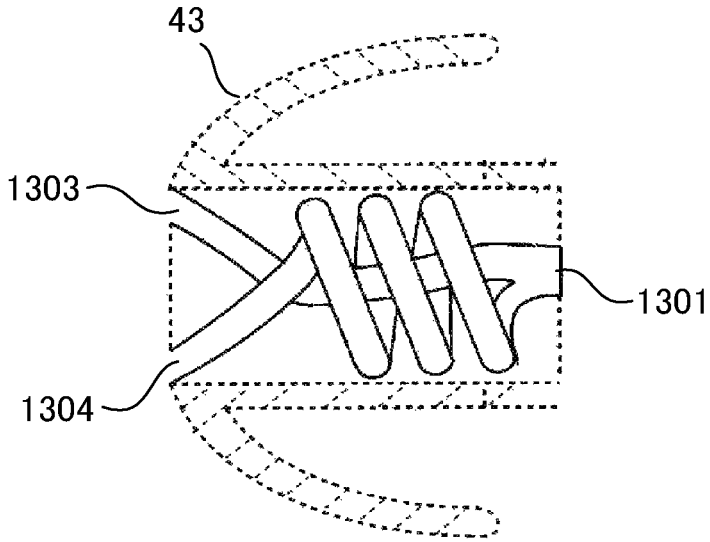
FIG. 13A is a view showing an example of an ear piece with a delayed branched sound guiding tube.

Hereinafter, an ear piece having the branched sound guiding tubes having different lengths is referred to as an ear piece with delayed branched sound guiding tubes. FIG. 13A shows a schematic diagram of the ear piece with delayed branched sound guiding tubes for a right ear having the branched sound guiding tube formed into a coil shape in part and generating a longer delay time. Reference numeral 1301 is a connection port to the sound-emission unit, reference numeral 1303 is a direct-sound sound wave radiation opening, and reference numeral 1304 is an indirect-sound sound wave radiation opening.

The shortest sound guiding tube in the ear piece is a first sound guiding tube, an ear piece having N (N is natural number) sound guiding tubes for delay time production which are longer than the first sound guiding tube and have different lengths is referred to as an ear piece with DN sound guiding tubes (D of DN means delay, and N represents the number of the sound guiding tubes), and the shortest sound guiding tube is a sound guiding tube for direct sound. Other sound guiding tubes for delay are collectively referred to as D tubes. When one or more D tubes are provided, in order to identify the D tubes, the individual sound guiding tubes for delay are DN sound guiding tubes (N is natural number). For example, a D1 sound guiding tube is a first sound guiding tube for delay, and a D2 sound guiding tube is a second sound guiding tube for delay.

Figure 13B:
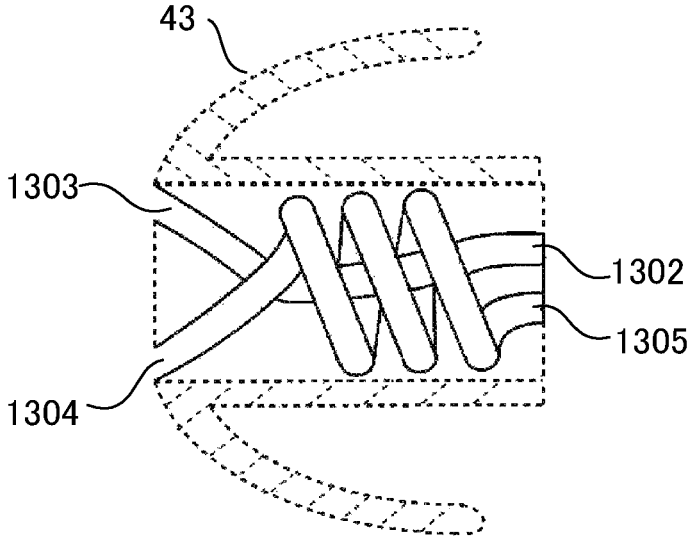
FIG. 13B is a view showing an example of an ear piece with a D1 sound guiding tube.

FIG. 13B shows an ear piece with the D1 sound guiding tube, in which a portion of the sound guiding tube for delay time production is formed into a coil shape. Reference numeral 1302 is a first sound guiding tube, reference numeral 1305 is the D1 sound guiding tube and represents a connection port with a sound-emission unit for direct sound, reference numeral 1303 is a direct-sound sound wave radiation opening, and reference numeral 1304 is a sound wave radiation opening of the D1 sound guiding tube. FIG. 13A and FIG. 13B show only the shape of the sound guiding tube in the ear piece for ease of understanding. The dashed lines of reference numeral 43 show an ear piece umbrella-shaped portion.

A coronal plane to be described in the present specification means an arbitrary plane for dividing a body of a living organism into a belly side and a back side (in human beings, a front side and a back side), and a sagittal plane means a plane for dividing a body of an animal parallel with respect to the midline of the bilaterally symmetrical body of the animal. Although a plane for equally dividing the body right and left along the midline is most effective, parallel planes shifted left or right are also sagittal planes. Since the sagittal plane is orthogonal to a cross section (transverse plane), the sagittal plane is a kind of longitudinal cross sections (vertical plane). The sagittal plane is also orthogonal to the coronal plane.

Figure 14A:
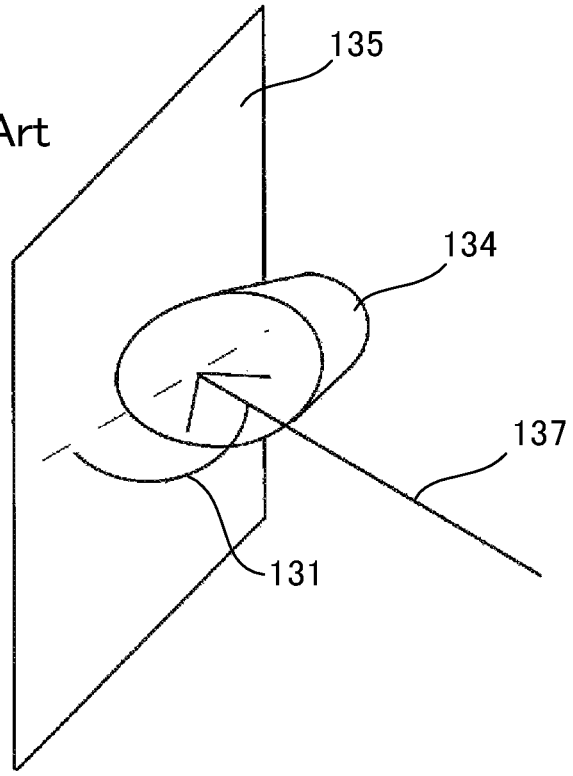
FIG.14A Prior Art
FIG. 14A is a view for explaining a sagittal plane axis incident angle.
Figure 14B:
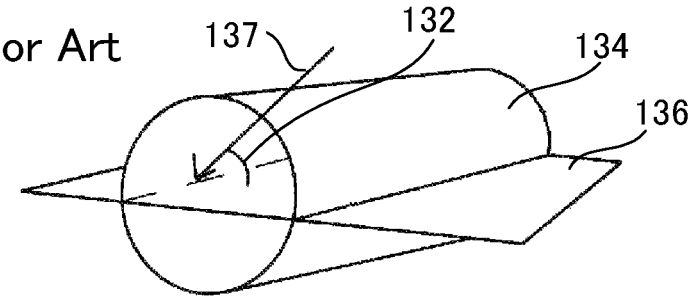
FIG.14B Prior Art
FIG. 14B is a view for explaining a cross section axis incident angle.

FIG. 14A is a pattern schematic diagram of a portion of the external auditory canal 134. An incident angle 131 to a sagittal plane of a directional sound wave radiation axis 137 to a sagittal plane 135 passing through a point at which the directional sound wave radiation axis of the sound-emission unit intersects with the external auditory canal wall is a sagittal plane axis incident angle. FIG. 14B is also a pattern schematic diagram of a portion of the external auditory canal 134. When an incident angle 132 of the directional sound wave radiation axis 137 to a cross section 136 passing through a point at which the directional sound wave radiation axis intersects with the external auditory canal wall is a cross-section axis incident angle, a plurality of sound-emission units are stored in one housing, and the directional sound wave radiation axes of a plurality of sound-emission units or branched sound guiding tube sound wave radiation axes of the multiple sound wave radiation axis sound-emission unit face different external auditory canal wall portions in such a state that a front end of an ear piece having a plurality of sound guiding tubes connected to a plurality of sound-emission units is inserted in the external auditory canal. Alternatively, the sound guiding tubes are arranged in the ear piece so that the sagittal plane axis incident angles or the cross section axis incident angles are different even in the same external auditory canal wall portion, whereby the sound wave information arrived from a large number of directions can be transmitted to the eardrum. When a receiver is constituted of a multiple sound wave radiation axis sound-emitter or a plurality of sound-emission units in which the sagittal plane axis incident angles, the cross section axis incident angles, or both of them are different, the sound information from more directions can be input to the eardrum.

The first multi-branched sound guiding tube and the second multi-branched sound guiding tube are arranged in one ear piece. The branched sound guiding tube sound wave radiation axis of the shortest branched sound guiding tubes of the first multi-branched sound guiding tube is arranged to face the side wall on the front head side of the external auditory canal in the external auditory canal portion into which the front end of the ear piece is inserted, and the branched sound guide sound wave radiation axis of the shortest branched sound guiding tubes of the second multi-branched sound guiding tube is arranged to face the side wall on the back head side of the external auditory canal in the external auditory canal portion into which the front end of the ear piece is inserted. The main sound guiding tube of the first multi-branched sound guiding tube is referred to as a first main sound guiding tube, the main sound guiding tube of the second multi-branched sound guiding tube is referred to as a second main sound guiding tube, and the ear piece is referred to as a front and back multi-branched sound guiding tube ear piece. In a canal-type receiver in which a sound-emission unit for direct sound is connected to the first main sound guiding tube of the front and back multi-branched sound guiding tube ear piece, and a sound-emission unit for indirect sound is connected to the second main sound guiding tube, more natural hearing can be realized.

In the front and back multi-branched sound guiding tube ear piece, surround reproduction is allowed, and when a sound-emission unit for front sound is connected to the first main sound guiding tube and a sound-emission unit for back sound is connected to the second main sound guiding tube, more natural surround reproduction is allowed.

In the canal-type receiver, when a convex object is disposed from a sound wave radiation end surface (reference numeral 12 of FIG. 1) of the sound guiding tube in the ear piece cylindrical portion to the housing sound guiding tube of the sound-emission unit connected to the sound guiding tube or in the housing sound guiding tube, this can be functioned as a sound wave diffuser, a sound wave reflector, or a sound wave reflection diffuser having both the functions of the sound wave diffuser and the sound wave reflector.

Figure 15A:
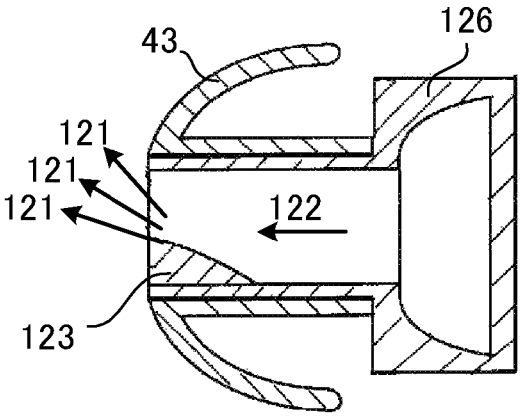
FIG. 15A to FIG. 15C are views showing an example of a sound wave diffuser or a sound wave reflector.
Figure 15B:
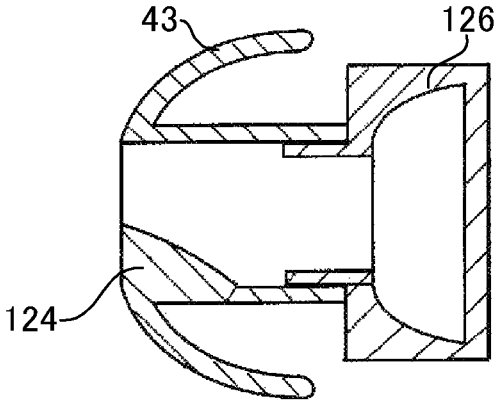
Figure 15C:
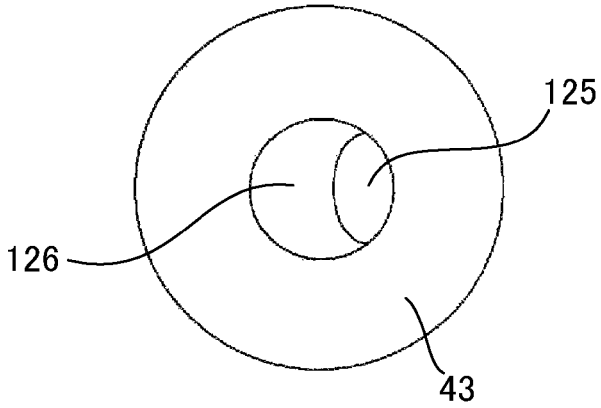

In a canal-type receiver having a sound guiding tube (tubular portion) inserted into the external auditory canal, FIG. 15 shows an embodiment for a right ear provided with a sound wave reflection diffuser having a sound diffusion action and a sound reflection action in a cavity from a sound wave radiation end surface (reference numeral 15 of FIG. 2) of the sound guiding tube in the ear piece cylindrical portion to the housing sound guiding tube of the sound-emission unit connected to the sound guiding tube and having a smooth surface. FIG. 15A and FIG. 15B are cross-sectional views, and FIG. 15C is a front view seen from the eardrum side. FIG. 15A shows an example in which a sound reflection diffuser 123 is provided in the housing sound guiding tube, and the sound reflection diffuser has such a shape that a sound wave is radiated so that a sound wave 122 radiated from the sound-emitter is reflected by the sound reflection diffuser and diffused on the external auditory canal wall on the front head side of the external auditory canal in such a state that the front end of an ear piece is inserted into the external auditory canal. In an example of FIG. 15B, the sound reflection diffuser has a structure 124 in which a portion of an internal surface of a sound guiding tube in an ear piece cylindrical portion of a member constituted by an ear piece is bulged into a convex shape to have a smooth curved surface. FIG. 15C is a view seen from the eardrum side of FIG. 15B having the sound reflection diffuser on the sound guiding tube internal surface in the ear piece. Reference numeral 125 is a sound wave reflection diffuser cut end surface, reference numeral 126 is a sound wave radiation opening, and reference numeral 43 is an umbrella-shaped portion of the ear piece.

The sound wave diffuser, the sound wave reflector, or the sound wave reflection diffuser having both the functions of the sound wave diffuser and the sound wave reflector may have such a shape that the sound wave 122 radiated from the sound-emitter as shown in FIG. 15A is reflected by the sound wave diffuser or the sound wave reflector to be uniformly reflected and diffused by a targeted predetermined external auditory canal wall, and, thus, to be radiated. The diffused sound wave has a function equal to an infinite number of sound wave radiation axes 121, and an effect of providing more natural hearing is provided.

As the effects of the sound wave diffuser and the sound reflector, the heard sound does not become stimulating sound, but natural and soft sound can be heard. The naturally arrived sound including the indirect sound should be transmitted to the external auditory canal wall from a large number of directions, and when the sound wave diffuser and the sound reflector are arranged, the sound wave is diffused to the targeted external auditory canal wall to be radiated; therefore, it is effective to approach more natural sound. Particularly, the effect is marked in high sound. The sound wave diffuser or the sound wave reflector can be realized by providing a projected object in a portion of the interior surface of the sound guiding tube of the ear piece cylindrical portion or a portion in the housing sound guiding tube. Any material and shape are applicable as long as the sound wave can be reflected. A support piece portion extending from the sound wave radiation end surface of the sound guiding tube is formed, and the sound wave diffuser or the sound wave reflector is spaced apart from the ear piece sound wave radiation end surface and may be disposed in the support piece portion to be closer to the eardrum. As an alternative to the sound reflection diffuser, when the shape of the cavity of the sound guiding tube is a phone shape as shown in FIG. 7D, the sound wave may be diffused and radiated to the target external auditory canal. Reference numeral 62 is the shape of the cavity connected to the housing sound guiding tube, and reference numeral 61 is the shape of the cavity of the sound wave radiation opening.

A tube-type (sound guiding tube-type) stereo earphone used in an airplane sheet has a drawback that only unnatural sound lateralized can be heard. Also in the tube-type stereo earphone used in an airplane sheet, by virtue of the utilization of the principle of the front localization receiver of the present invention, when a sound guiding tube is arranged in an ear piece cylindrical portion so that the sound wave is radiated while a sound guiding tube sound wave radiation axis of a tube in an ear piece inserted into the external auditory canal faces the side wall on the front head side of the external auditory canal in the external auditory canal portion into which the front end of the ear piece is inserted, forward-localized hearing is allowed. As described above, the sound guiding tube arranged in the ear piece cylindrical portion is referred to as a forward localization tube, and a receiver using the sound guiding tube is referred to as a forward localization tube receiver. When the receivers are used a pair of left and right receivers, the pair of the receivers is used as forward-localized tube-type stereo earphones.

By virtue of the utilization of the principle of the backward localization receiver of the present invention, when a sound guiding tube is arranged in an ear piece cylindrical portion so that the sound wave is radiated while a sound guiding tube sound wave radiation axis of a tube inserted into the external auditory canal faces the side wall on the back head side of the external auditory canal in the external auditory canal portion into which the front end of an ear piece is inserted, backward-localized hearing is allowed. An ear piece in which both the forward localization tube and the backward localization tube are arranged in one ear piece cylindrical portion is referred to as a front and back sound field tube ear piece, and a receiver using the front and back sound field tube ear piece is referred to as a front and back sound field tube receiver. The front and back sound can be distinguished from each other by using the front and back sound field tube receiver. When the receivers are used a pair of left and right receivers, surround reproduction is allowed.

Further, in the surround reproduction, the front and back sound ear piece is used, and a tube for front sound conducting the sound from a forward sound-emission unit may be connected to a first sound guiding tube of the front and back sound ear piece, and a tube for back sound conducting the sound from a backward sound-emitter may be connected to a second sound guiding tube of the front and back sound ear piece.

Figure 16A:
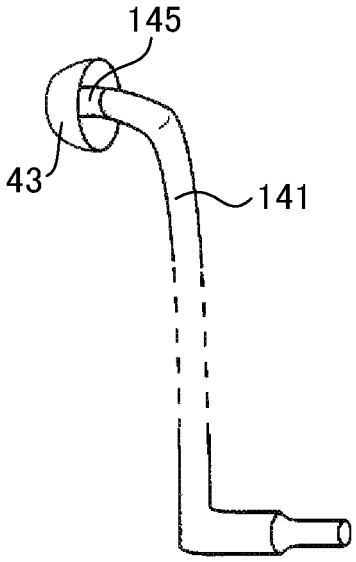
FIG. 16A to FIG. 16C are views showing an example of a tube-type headphone for a right ear.
Figure 16B:
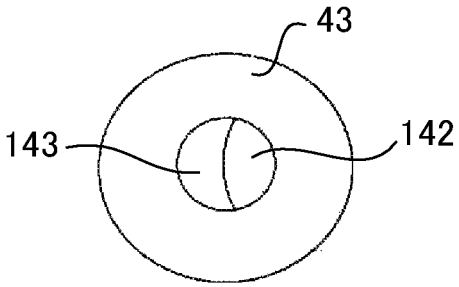
Figure 16C:
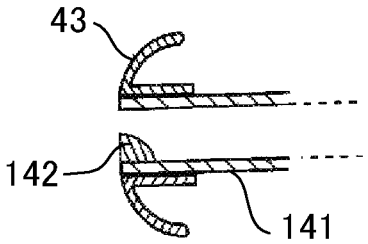

FIG. 16A is a schematic diagram of a tube-type headphone and shows a schematic perspective view of an ear piece to be inserted into a right ear and a tube. The tube-type headphone is a tube-type (sound guiding tube-type) stereo earphone mainly used in an airplane sheet. The sound wave is radiated from a sound wave radiation opening of an ear piece toward the external auditory canal wall on the front head side by using a reflection diffuser provided in a tube while the sound guiding tube sound wave radiation axis of the tube on the sound wave radiation end surface of a tube sound guiding tube in an ear piece cylindrical portion 145 faces the side wall on the front head side of the external auditory canal in the external auditory canal portion into which the front end of an umbrella-shaped portion 43 of the ear piece is inserted. FIG. 16B is a front view of the ear piece to be inserted into a right ear as seen from the external auditory canal opening and shows a sound wave radiation opening 143 and a reflection diffuser 142. FIG. 16C shows a cross-sectional surface as an example of an embodiment using the reflection diffuser 142. Reference numeral 43 is the umbrella-shaped portion When the tube sound guiding tubes are used as a pair of left and right receivers, the pair of the receivers is used as forward-localized tube-type stereo ear phones. The front and back sound ear piece is used as a surround device, and as shown in FIG. 17, a tube sound guiding tube 151 for front sound and a tube sound guiding tube 152 for back sound are arranged in the ear piece cylindrical portion to be inserted into a right ear of FIG. 16. There is shown an embodiment of a surround device provided so that the surround back-sound sound wave is radiated from a sound wave radiation opening of an ear piece by using a reflection diffuser provided in a tube while the sound guiding tube sound wave radiation axis in a sound wave radiation front end portion of the tube sound guiding tube for back sound faces the side wall of the back head of the external auditory canal in the external auditory canal portion into which the front end of the ear piece is inserted.

Figure 17A:
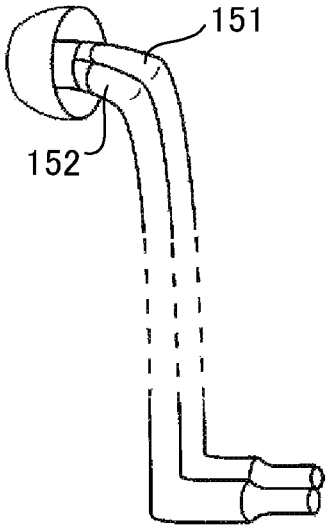
FIG. 17A to FIG. 17C are views showing an example of a tube-type surround headphone for a right ear.
Figure 17B:
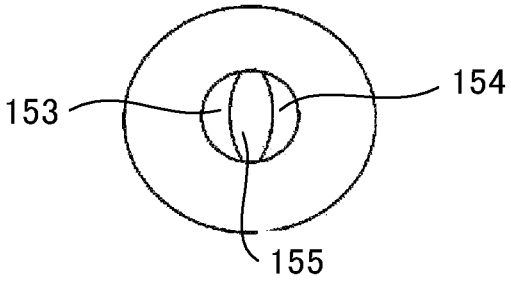
Figure 17C:
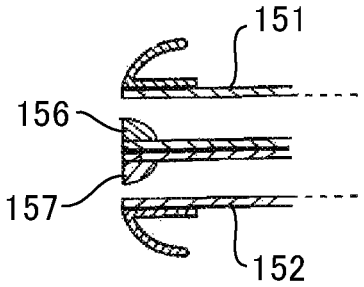

FIG. 17 shows an embodiment of a tube-type front and back earphone for a right ear using a reflection diffuser 156 for front sound and a reflection diffuser 157 for back sound. FIG. 17A shows a schematic perspective view of an ear piece to be inserted into a right ear and a tube of the tube-type headphone capable of reproducing the sound field. A tube sound guiding tube for front sound and a tube sound guiding tube for back sound are arranged in one ear piece cylindrical portion. When a pair of left and right earphones are provided, the earphones are used as a tube-type surround receiver allowing surround reproduction. FIG. 17B is a front view of the ear piece seen from the external auditory canal opening of the ear piece to be inserted into a right ear and shows a sound wave radiation opening 153 for front sound and a sound wave radiation opening 154 for back sound. Reference numeral 155 is a cut end surface of front and back reflection diffusers. FIG. 17C shows an example of a shape of a reflection diffuser 156 for forward and a reflection diffuser 157 for backward in a cross-sectional view of an ear piece. Reference numeral 151 is a tube sound guiding tube for front sound, and reference numeral 152 is a tube sound guiding tube for back sound.

The invention claimed is:

1. A canal-type receiver comprising an ear piece used while being inserted into the external auditory canal, wherein the ear piece has a substantially cylindrical shape and includes a cylindrical portion including a sound guiding tube emitting a sound wave, radiated from a sound-emission unit in the receiver, into the external auditory canal, and the sound guiding tube is configured that a directional sound wave radiation axis of the sound wave faces a predetermined position of a wall of the external auditory canal in such a state that the cylindrical portion of the ear piece is mounted at a predetermined position in the external auditory canal, whereby the sound wave radiated from the sound guiding tube is reflected by a portion of the wall of the external auditory canal to be arrived at the eardrum, thereby to have a sound image localized to forward, backward, upward or downward.

2. The canal-type receiver according to claim 1, wherein a substantially cylindrical housing sound guiding tube emitting sound from a front end projectingly provided on a front surface of a housing of the sound-emission unit is a sound guiding tube in the ear piece.

3. The canal-type receiver according to claim 1, wherein the directional sound wave radiation axis of the sound guiding tube is configured to face a side wall on the front head side in the external auditory canal.

4. The canal-type receiver according to claim 3, further comprising:

a second sound guiding tube provided in the ear piece; and a second sound-emission unit radiating the sound wave to the second sound guiding tube, wherein the directional sound wave radiation axis of the second sound guiding tube is configured to face a side wall on the back head side in the external auditory canal.

5. The canal-type receiver according to claim 1, further comprising:

one or more sound guiding tubes in the earpiece; and one or more sound-emission units connected to each of the sound guiding tubes, wherein the directional sound wave radiation axes of the sound guiding tubes are configured to face different directions in the external auditory canal.

6. The canal-type receiver according to claim 5, wherein a sound guiding tube sound-emitter constituted of the shortest sound guiding tube of the sound guiding tubes and a sound-emission unit connected to the sound guiding tube is used for direct sound, the directional sound wave radiation axis of the shortest sound guiding tube is configured to face a side wall on the front head side in the external auditory canal, all sound guiding tube sounding bodies other than the sound guiding tube sound-emitter for direct sound are used for indirect sound, and the directional sound wave radiation axes of the sound guiding tube sounding bodies for indirect sound face different external auditory canal wall portions other than the side wall on the front head side.

7. An ear piece configured for use in the canal-type receiver according to claim 1, wherein the ear piece has a substantially cylindrical shape and includes a sound guiding tube, and the sound guiding tube is configured so that the directional sound wave radiation axis of the sound wave faces a predetermined position in the external auditory canal wall in such a state that the ear piece is mounted at a predetermined position in the external auditory canal.

8. The ear piece configured for use in the canal-type receiver according to claim 7, wherein the directional sound wave radiation axis of the sound guiding tube is configured to face the side wall on the front head side in the external auditory canal.

9. The ear piece configured for use in the canal-type receiver according to claim 8, further comprising a second sound guiding tube, wherein the directional sound wave radiation axis of the second sound guiding tube is configured to face the side wall on the back head side in the external auditory canal.

10. The ear piece configured for use in the canal-type receiver according to claim 8, further comprising second and third sound guiding tubes, wherein the directional sound wave radiation axis of the second sound guiding tube is configured to face an upper side wall in the external auditory canal, and the directional sound wave radiation axis of the third sound guiding tube is configured to face a lower side wall in the external auditory canal.

11. The ear piece configured for use in the canal-type receiver according to claim 9, further comprising third and fourth sound guiding tubes, wherein the directional sound wave radiation axis of the third sound guiding tube is configured to face an upper side wall in the external auditory canal, and the directional sound wave radiation axis of the fourth sound guiding tube is configured to face a lower side wall in the external auditory canal.

12. The ear piece configured for use in the canal-type receiver according to claim 7, wherein the N (N is a natural number not less than 2) sound guiding tubes are provided, and the directional sound wave radiation axis of the shortest sound guiding tube of the sound guiding tubes is configured to face the side wall on the front head side in the external auditory canal.

13. The ear piece configured for use in the canal-type receiver according to claim 7, wherein a portion of the sound guiding tube connected to a housing sound guiding tube of the sound-emission unit is a main sound guiding tube, a portion other than the main sound guiding tube is a multi-branched sound guiding tube branched into a plurality of branched sound guiding tubes, and the directional sound wave radiation axes of all the branched sound guiding tubes of the multi-branched sound guiding tube face a predetermined position on the external auditory canal wall.

14. The ear piece configured for use in the canal-type receiver according to claim 13, wherein the directional sound wave radiation axis of the shortest branched sound guiding tube of the branched sound guiding tubes included in the multi-branched sound guiding tube is configured to face a side wall on the front head side in the external auditory canal.

15. The ear piece configured for use in the canal-type receiver according to claim 14, wherein some or all the directional sound wave radiation axes of the sound guiding tubes other than the shortest branched sound guiding tube of the branched sound guiding tubes included in the multi-branched sound guiding tube face a side wall on the back head side in the external auditory canal.

16. The ear piece configured for use in the canal-type receiver according to claim 7, wherein a sound reflection diffuser having a function of diffusing or reflecting the sound wave is provided in a portion of an interior surface near a sound wave radiation opening of the sound guiding tube.

17. The ear piece configured for use in the canal-type receiver according to claim 7, wherein the sound guiding tube has a phone shape whose diameter is gradually expanded toward a sound wave radiation opening of an ear piece front end.

18. The ear piece configured for use in the canal-type receiver according to claim 7, wherein a portion of a tubular portion of a sound wave radiation opening of the sound guiding tube is extended to form a support piece portion, and the support piece portion is a sound wave reflection diffuser having a function of diffusing or reflecting the sound wave.

* * * * *